United States Patent [19]

Forrest et al.

[11] Patent Number: 4,530,162

[45] Date of Patent: Jul. 23, 1985

[54] APPARATUS AND METHOD FOR BORESIGHTING A FIREARM

[75] Inventors: Robert S. Forrest, 2101 San Lu Rae, SE., East Grand Rapids, Mich. 49506; Floyd Brouwer, Jenison; Merlin J. Applegate, Grand Rapids, both of Mich.

[73] Assignee: Robert S. Forrest, East Grand Rapids, Mich.

[21] Appl. No.: 521,044

[22] Filed: Aug. 8, 1983

[51] Int. Cl.[3] ..... F41G 1/54

[52] U.S. Cl. ..... 33/228; 33/234; 356/153

[58] Field of Search ..... 33/234, 228, 227; 356/241, 153, 154, 138

[56] References Cited

U.S. PATENT DOCUMENTS

| | | | |
|---|---|---|---|
| 793,131 | 6/1905 | Henkes | 33/234 |
| 953,696 | 4/1910 | Konig | 33/234 |
| 962,175 | 6/1910 | Straubel | 33/234 X |
| 1,662,836 | 3/1928 | Steinle | 356/153 |
| 2,383,466 | 8/1945 | Brown | 33/234 |
| 2,573,703 | 11/1951 | Gardner | 356/138 |
| 2,669,024 | 2/1954 | Flanagan | 33/234 |
| 2,773,309 | 12/1956 | Elliott | 33/46 |
| 3,228,108 | 1/1966 | Chaperon | 33/234 |
| 3,453,385 | 7/1969 | Capellaro | 178/6.8 |
| 3,711,204 | 1/1973 | Steck | 356/153 |
| 3,782,832 | 1/1974 | Hacskaylo | 356/153 |
| 3,787,693 | 1/1974 | Stone | 250/330 |
| 3,813,795 | 6/1974 | Marshall et al. | 35/25 |
| 4,136,956 | 1/1979 | Eichweber | 356/153 |
| 4,168,429 | 9/1979 | Lough | 250/330 |

*Primary Examiner*—William D. Martin, Jr.

*Attorney, Agent, or Firm*—Price, Heneveld, Huizenga & Cooper

[57] ABSTRACT

The specification discloses a system and method for boresighting a firearm using laser technology. More specifically, the system includes a light source for directing a collimated beam of light through the barrel and a muzzle insert defining an aperture having a smaller diameter than the collimated beam. Both the light source and muzzle insert aperture are concentric with the barrel bore, such that the light beam emitted from the bore is a coaxial extension of the barrel usable for boresighting purposes. In a preferred embodiment of the invention, the muzzle insert includes a translucent material such that the location of the beam on the insert can be monitored to facilitate alignment of the beam with the barrel.

13 Claims, 9 Drawing Figures

APPARATUS AND METHOD FOR BORESIGHTING A FIREARM

BACKGROUND OF THE INVENTION

The present invention relates to devices for boresighting firearms, and more particularly to such devices and methods utilizing light beams.

A wide variety of boresighting devices have been developed to facilitate proper alignment of the firearm scope or sight with the firearm bore. One such device includes a cartridge-shaped housing which fits within the chamber of the firearm. The housing includes a peephole at its rear end and a cross hair at its forward end such that one can look through the peephole and cross hair structure to precisely align the firearm bore with a target. The scope can then be adjusted as necessary to also bring the scope into a desired alignment with the target. An example of this device is seen in U.S. Pat. No. 2,773,309, entitled BORESIGHTING DEVICE FOR FIREARMS, issued Dec. 11, 1956, to Elliott. However, the housing, when slightly misaligned within the chamber, will create relatively large errors in the alignment of the bore with the target. Alignment of the scope under these conditions will not properly boresight the firearm.

Another device includes a light emitting device housed within a cartridge-shaped housing, which fits within the firearm chamber. The light emitting device directs a beam of light through the firearm bore and onto a target so that the bore can be aligned with the target. The scope is then also aligned with the target using either visual sighting or a second light emitting device on the scope. An example of this system is illustrated in U.S. Pat. No. 3,782,832, entitled METHOD OF BORESIGHT ALIGNMENT OF A WEAPON, issued Jan. 1, 1974, to Hacskaylo. However, as with the previously described device, slight misalignment of the housing within the chamber will cause relatively large errors in the alignment of the bore with the target.

Other boresighting devices have been developed and are typically mounted in the muzzle end of the firearm barrel. Examples of these devices are illustrated in U.S. Pat. No. 4,168,429, entitled INFRARED BORESCOPE DEVICE AND METHOD OF BORESIGHT ALIGNMENT OF A WEAPON, issued Sept. 18, 1979, to Lough; U.S. Pat. No. 3,787,693, entitled BORESIGHT ALIGNMENT DEVICE, issued Jan. 22, 1974, to Stone; and U.S. Pat. No. 2,711,204, entitled OPTICAL SIGHT ALIGNER, issued Jan. 16, 1973, to Steck.

SUMMARY OF THE INVENTION

The aforementioned problems are overcome by the present invention. Essentially, a boresighting system is provided including structure for concentrically aligning a collimated beam of light within the firearm bore at both the chamber end and the muzzle end of the barrel. Once the collimated beam of light is known to be concentric with both ends of the bore, the beam is known to be accurately coaxially aligned with the bore. Therefore, the beam exiting the barrel constitutes an imaginary accurate extension of the barrel usable for boresighting purposes.

More specifically, the device includes a light source assembly mountable within the chamber end of the firearm barrel for directing a collimated beam of light through the barrel toward the muzzle. The light source assembly includes structure for concentrically positioning the light outlet within the chamber end of the firearm. The boresighting device further comprises a muzzle assembly insertable into the muzzle end of the barrel to define an aperture generally concentric with the muzzle end. The muzzle insert aperture is smaller in diameter than the diameter of the collimated beam of light. Further, the muzzle insert includes structure for indicating the position of the collimated beam with respect to the aperture.

The device is used by inserting the collimated light source assembly within the chamber end of the barrel such that the collimated beam is concentric with the bore as it exits the light source. The muzzle assembly is inserted into the muzzle end. The position of the collimated beam with respect to the muzzle insert is read on the indicating structure, and the light source is manipulated as necessary to concentrically position the beam about the muzzle insert aperture. The light beam, which is then concentric with both the chamber end and the muzzle end of the bore, is coaxially aligned with the bore. Therefore, that portion of the light beam exiting the bore through the muzzle insert aperture constitutes an imaginary coaxial extension of the bore usable for precision alignment of the firearm scope or sight.

The present invention comprises an apparatus and method for relatively easily, yet precisely, boresighting a firearm. The concentric alignment of the collimated beam at both the rear and forward ends of the firearm barrel insure that the beam will be properly coaxially aligned with the firearm barrel. Therefore, the scope can be adjusted with greater precision and repeatability than has been possible in previous boresighting devices and methods.

These and other objects, advantages, and features of the invention will be more readily understood and appreciated by reference to the detail description of the preferred embodiment and the drawings.

DETAILED DESCRIPTION OF THE PREFERRED EMBODIMENT

Figure 1:
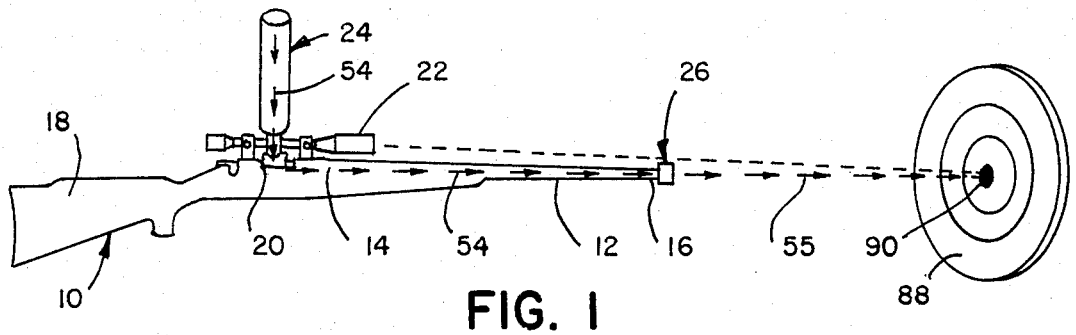
FIG. 1 is an elevational view of a firearm with the boresighting apparatus of the present invention mounted thereon.
Figure 2:
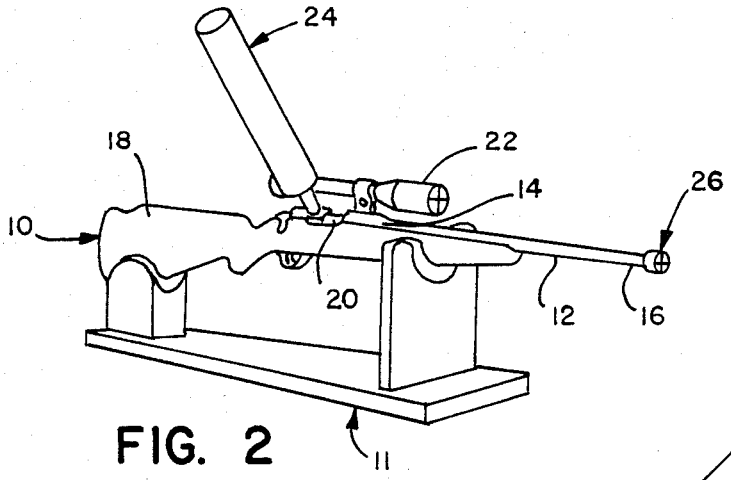
FIG. 2 is a perspective view of the firearm and boresighting apparatus.

A boresighting apparatus constructed in accordance with a preferred embodiment of the invention is illustrated in the drawings and is shown mounted on a firearm or rifle 10 (FIGS. 1 and 2). Although the present invention is illustrated in conjunction with a rifle, it will be readily appreciated by those having ordinary skill in the art that the present apparatus is equally adaptable to any firearm. As is generally well known, rifle 10 includes barrel 12 having a rear, or chamber, end 14 and a forward, or muzzle, end 16. The firearm further includes stock 18, receiver 20, and scope or sight 22.

Figure 6:
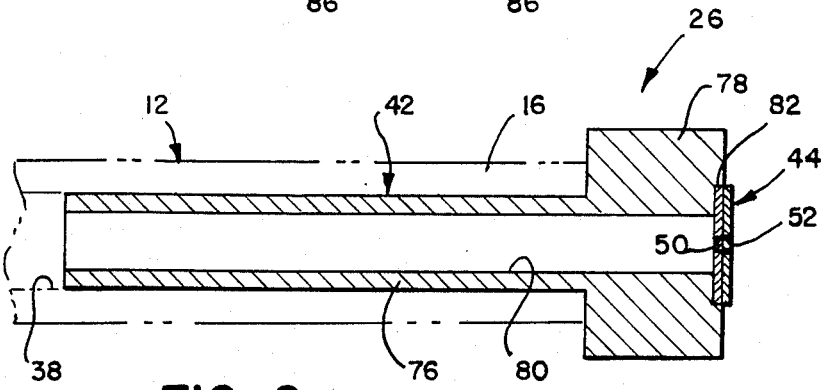
FIG. 6 is a sectional view of the muzzle insert assembly with the firearm barrel shown in phantom.
Figure 7:
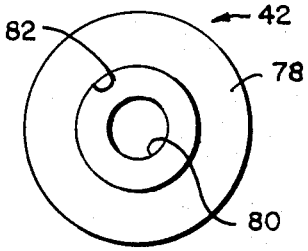
FIG. 7 is an end elevational view of the muzzle insert assembly with the target assembly removed.
Figures 3, 9:
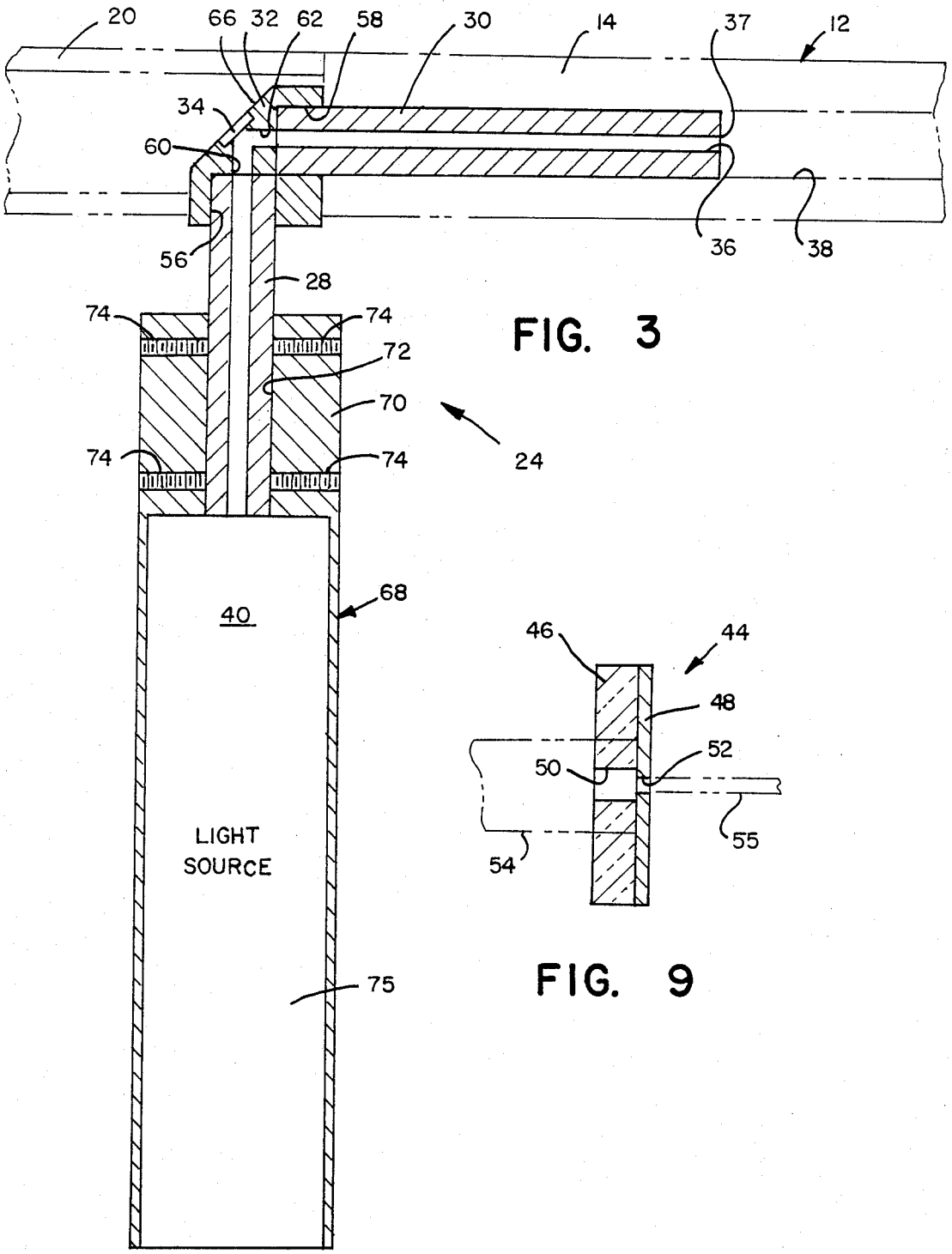
FIG. 3 is a sectional view of the light source assembly with the firearm chamber and receiver shown in phantom.
FIG. 9 is an enlarged sectional view of the target assembly of the muzzle insert assembly.

The boresighting device includes light source assembly 24 mountable within chamber end 14 of barrel 12 and muzzle assembly 26 mountable within muzzle end 16 of the barrel. Light source assembly 24 (FIG. 3) includes two tubular extensions 28 and 30 interconnected at a 90 degree angle within chamber elbow 32, which also supports 45-degree mirror 34. Bore extension 30 fits closely within chamber end 14 of barrel 12 such that bore 36 and light outlet 37 of the extension are positioned concentrically within firearm bore 38. Light source assembly 24 further includes a light source 40 for directing a collimated beam of light through extension 28 which beam is reflected by mirror 34 to travel coaxially within barrel extension 30. The beam exiting the barrel extension is also concentrically positioned within firearm bore 38. Muzzle insert assembly 26 (FIG. 6) includes a generally tubular support 42 supporting target assembly 44 (see also FIGS. 8 and 9). Target assembly 44 (FIG. 9) includes translucent disc 46 and generally opaque target plate 48 secured together in overlying relationship. Insert support 42 fits closely within firearm bore 38 (FIG. 6) and supports apertures 50 and 52 within member 46 and plate 48, respectively, in concentric relationship to the firearm bore. When light source 40 is activated, a collimated beam of light is directed against translucent member 46, which beams is then visible within the translucent member through target plate 48. Light source assembly 24 is then manipulated or adjusted as necessary such that the collimated beam 54 is concentrically positioned with plate aperture 52 and therefore muzzle end 16 of firearm bore 38. That portion of beam 54 directed onto aperture 52 exits the firearm barrel 12 as reduced beam 55. Because of the concentric alignment of light beam 54 within chamber and muzzle ends 14 and 16, the exiting collimated beam 55 is an accurate coaxial extension of firearm bore 38.

Figure 5:
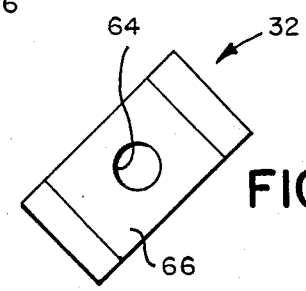
FIG. 5 is a view of the chamber assembly elbow taken along plane V—V in FIG. 4.
Figure 4:
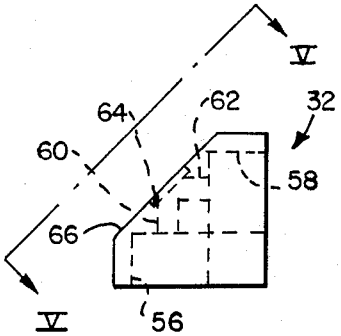
FIG. 4 is a plan view of the chamber assembly elbow.

Turning more specifically to the various elements of the boresighting apparatus, light source assembly 24 (FIG. 3) will be first described. Extensions 28 and 36 are both fabricated of tubular brass stock and have an outside diameter of 0.500 inch and an inside diameter of 0.13 inch. The outer diameter is selected to match the inner diameter of chamber end 14, which in the illustrated 30-06 firearm 10 is a 0.500 inch inner diameter chamber. Optionally extension 30 is fitted with sleeves to accommodate different diameter bores. Both extensions 28 and 30 are secured within chamber elbow 32. Chamber elbow 32 (FIGS. 4 and 5) includes two circular extension-receiving chambers 56 and 58, each of which has an inside diameter of 0.500 inch to closely receive extensions 28 and 30, respectively (see FIG. 3). Coaxially aligned with chambers 56 and 58 are circular bores 60 and 62, respectively, each of which has an inside diameter of 0.13 inch which is the same as the inside diameter of extensions 28 and 30. Mirror counterbore 64 is generally circular and formed within 45 degree surface 66 at the junction of bores 60 and 62. Mirror 34 (FIG. 3) is mounted within counterbore 64 and is oriented at a 45 degree angle with respect to both bores 60 and 62, and therefore extensions 28 and 30.

Light source assembly 24 further includes laser mount 68 fabricated of aluminum which houses laser light source 40 or any other source of collimated light. Laser mount 68 includes concentric mount 70 having an inside diameter of 0.500 inch to closely receive extension 28 therein. Set screws 74 are included within concentric mount 70 to secure extension 28 therein. A conventional source of collimated light, for example a laser, is housed within cylindrical cavity 75 and is arranged to diameter of 0.090 inch through extension 28 toward mirror 34. Suitable light sources are generally well known to those having ordinary skill in the art and consequently are not reviewed in detail herein. The inclusion of elbow 32 and mirror 34 enables a conventional light source to be used in the present invention because the light source need not fit entirely within the chamber end 14.

Muzzle insert assembly 26 (FIG. 6) includes a generally tubular support 42 and target assembly 44 supported therein. Support 42 is a one-piece member fabricated of brass and includes an elongated neck 76 dimensioned to be closely received within firearm bore 38 and an enlarged collar 78 abutting muzzle end 16. In the illustrated embodiment, neck 76 has an outer diameter of 0.300 inch to be closely received within 30-06 rifle 10. As with extension 30, support 42 is fitted with sleeves as necessary to accommodate different diameter bores. Bore 80 extends the full length of support 42 and more particularly through neck 76 and shoulder 78. Counterbore 82 is formed in collar 78 concentric with bore 80. Target assembly 44 is mounted within counterbore 82.

Figure 8:
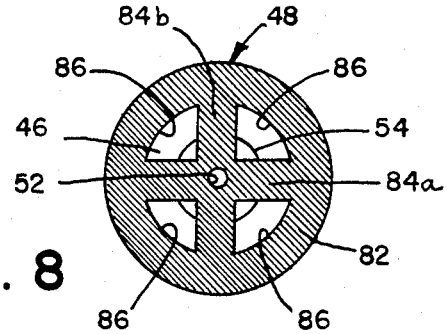
FIG. 8 is an enlarged plan view of the target plate.

Target assembly 44 (FIG. 9) is a two-piece assembly including circular translucent disc 46 and circular opaque target 48 laminated to one another using any well-known technique. Aperture 50 is positioned at the center of disc 46 and in the preferred embodiment has a diameter of approximately 0.03 to 0.04 inch. In the preferred embodiment, translucent member 46 is fabricated of an acrylic material sandpapered on one or both surfaces to provide translucent characteristics. Other translucent and/or frosted materials could be substituted for the preferred material. Target disc 48 (FIG. 8) preferably is fabricated of brass foil having a thickness of no greater than 0.01 inch and preferably a thickness of approximately 0.001 inch. Hole 52 is smaller than aperture 50 and in the preferred embodiment is approximately 0.02 inch in diameter and concentrically aligned with aperture 50 and bore 80. The thin target 48 minimizes or reduces refraction of the monochromatic collimated light beam passing through aperture 52. Preferably, aperture 52 is formed by double-side etching to form a knife edge about the aperture to further reduce refraction of beam 54. As seen in FIG. 8, brass target 48 includes circular periphery 82 supporting a pair of cross members **84*a* and 84*b* all having a width of approximately 0.050 inch. Aperture 52 is formed at the centers of cross members 84. Cross members 84 and peripheral portion 82 together define four circular segment voids 86 in disc 48 through which translucent disc 46 is visible. Consequently, the orientation or position of collimated beam 54 with respect to aperture 52 can be determined by observing the illumination of translucent material 46 by the collimated beam 54 through circular sectors 86**.

OPERATION

Firearm or rifle 2 to be boresighted is first placed within support 11 as illustrated in FIG. 2 before the boresighting apparatus is installed thereon. Light source assembly 24 is then operatively positioned within receiver 20 and chamber end 14 by inserting extension 30 into chamber end 14. In those firearms having a chamber integral with the barrel, chamber end 14 comprises the chamber; in those firearms wherein the chamber is not integral with the barrel, chamber end 14 comprises the rear end of the bore. Muzzle insert 26 is inserted within muzzle end 16 of barrel 12. As noted above, both extension 30 of assembly 24 and neck 76 of insert assembly 26 are dimensioned to be closely received within the firearm. Consequently, bore 36 is concentrically positioned within the rear or chamber end 14, and aperture 52 is concentrically positioned within muzzle end 16. Light source 40 is then actuated to direct a collimated beam of light from the light source through extension 28 to mirror 34. In the preferred embodiment, the collimated beam has a diameter of approximately 0.090 inch such that the beam does not contact the interior diameter of either extension 28 or 30. The beam is reflected off mirror 34 and through extension 30 such that the beam exiting assembly 24 through light outlet 37 is concentrically positioned within firearm bore 38.

The beam 54 exiting assembly 24 is directed onto translucent material 46 (FIGS. 8 and 9) and is visible through circular segments 86. Assembly 24 is then manipulated as necessary such that collimated beam 54 is concentric with target aperture 52 as illustrated in FIG. 8 by noting the orientation of the collimated beam with respect to circular segments 86. Typically, beam 54 is adjusted by manipulating light source 40 within laser mount 68, because extension 30 fits sufficiently closely within bore 38 to prevent significant alteration of the angle of mirror 34 with respect to the bore. After beam 54 has been concentrically aligned with aperture 52 as illustrated in FIG. 8, the beam is coaxially aligned within bore 38. Therefore, the portion 55 of beam 54 exiting the firearm through aperture 52 is a coaxial imaginary extension of the bore. Beam 55 is then directed at a target 88 to create light spot 90. Scope 22 is then adjusted as necessary to be focused in a desired relation to spot 90. Preferably, ammunition statistics are consulted to determine the rise or drop of a particular projectile between firearm 10 and target 88 such that the scope 22 is adjusted to compensate for this rise or drop.

The above description is that of a preferred embodiment of the invention. Various alterations and changes can be made without departing from the spirit and broader aspects of the invention as set forth in the appended claims, which are to be interpreted in accordance with the principles of patent law, including the doctrine of equivalents.

The embodiments of the invention in which an exclusive property or privilege is claimed are defined as follows:

1. A firearm boresighting device for use on a firearm including a barrel having a chamber end and an opposite muzzle end, said boresighting device comprising:

a chamber end assembly to be operatively supported by the chamber end of the barrel, said chamber end assembly including light outlet means for emitting a collimated beam of light having a first diameter, said chamber end assembly further including means for generally concentrically positioning said light outlet means within the chamber end; and a muzzle end assembly to be operatively supported by the muzzle end of the barrel, said muzzle end assembly including aperture supporting means for supporting an aperture having a diameter smaller than said collimated beam diameter, said aperture being generally concentric with the muzzle end of the barrel, said muzzle end assembly further including beam position indicating means for indicating the position of said collimated beam with respect to said aperture, whereby said beam can be concentrically oriented with respect to said aperture, and further whereby the portion of said collimated beam passing through said aperture when said beam is concentrically oriented with said aperture comprises an imaginary coaxial extension of said bore usable for boresighting purposes.

2. A boresighting device as defined in claim 1 wherein said beam position indicating means comprises a generally translucent member surrounding said aperture.

3. A boresighting device as defined in claim 2 wherein said beam position indicating means further comprises a target supported on said translucent member generally concentric with said aperture.

4. A boresighting device as defined in claim 3 wherein said target defines said aperture.

5. A boresighting device as defined in claim 4 wherein said target has a thickness of no greater than 0.01 inch to reduce refraction of said collimated beam passing therethrough.

6. A boresighting device as defined in claim 5 wherein said chamber end assembly comprises a mirror for reflecting said collimated beam from said light emitting means into the bore, whereby said light emitting means can be of conventional size.

7. A boresighting device as defined in claim 6 wherein said chamber end assembly comprises a first tubular member to be slidably received within the barrel, said mirror being positioned to reflect said collimated beam from said light emitting means into said first tubular member.

8. A boresighting device as defined in claim 1 wherein said chamber end assembly comprises a mirror for reflecting said collimated beam from said light emitting means into the barrel, whereby said light emitting means can be of conventional size.

9. A boresighting device as defined in claim 8 wherein said chamber end assembly comprises a first tubular member to be slidably received within said barrel, said mirror being positioned to reflect said collimated beam from said light emitting means into said first tubular member.

10. A boresighting device as defined in claim 2 wherein said muzzle end assembly comprises a generally opaque material defining said aperture, said material having a thickness of no greater than 0.01 inch to minimize refraction of said collimated beam passing therethrough.

11. A boresighting device as defined in claim 1 wherein said muzzle end assembly comprises a generally opaque material defining said aperture, said material having a thickness of no greater than 0.01 inch to minimize refraction of said collimated beam passing therethrough.

12. A method of boresighting a firearm comprising the steps of:

directing a collimated beam of light through the firearm barrel from the chamber end to the muzzle end, said directing step including maintaining said beam generally concentrically with the bore chamber end;

supporting a muzzle assembly on the muzzle, said muzzle assembly defining an aperture means generally concentric with the bore muzzle end, said aperture having a diameter no greater than the diameter of the collimated beam, said muzzle assembly further including means for indicating the position of the beam with respect to the aperture;

aligning said beam generally concentrically with said aperture by observing the position indicating means, whereby said beam will be generally coaxially aligned with said bore;

directing said beam against a reference surface; and aligning said scope in a desired relationship with said beam on said reference surface.

13. A boresighting assembly as defined in claim 19 wherein said directing step comprises:

reflecting the collimated beam from an orientation not aligned with the bore to an orientation aligned with the bore, enabling the use of a conventional size light source.

* * * * *

UNITED STATES PATENT AND TRADEMARK OFFICE

CERTIFICATE OF CORRECTION

PATENT NO. : 4,530,162

DATED : July 23, 1985

INVENTOR(S) : Robert S. Forrest et al

It is certified that error appears in the above-identified patent and that said Letters Patent is hereby corrected as shown below:

Column 1, line 22:
After "when" insert --only--
Column 2, line 37:
"detail" should be --detailed--
Column 3, line 32:
"beams" should be --beam--
Column 4, Between lines 7 and 8:
After "arranged to" insert --direct a collimated beam of light having a preferred--
Column 4, line 65:
"rifle 2" should be --rifle 10--

Column 8, Claim 13, Line 6:
"19" should be --12--

Signed and Sealed this

*Twenty-eighth* Day of *January 1986*

[SEAL]

*Attest:*

DONALD J. QUIGG

*Attesting Officer* *Commissioner of Patents and Trademarks*